US006146798A

United States Patent [19]

Bringans et al.

[11] Patent Number: 6,146,798

[45] Date of Patent: Nov. 14, 2000

[54] PRINTING PLATE WITH REVERSIBLE CHARGE-CONTROLLED WETTING

[75] Inventors: Ross D Bringans, Cupertino; Jaan Noolandi, Mountain View; David K Biegelsen, Portola Valley; David K Fork, Los Altos; Scott A Elrod, La Honda, all of Calif.

[73] Assignee: Xerox Corporation, Stamford, Conn.

[21] Appl. No.: 09/222,921

[22] Filed: Dec. 30, 1998

[51] Int. Cl.[7] ..... G03G 13/26

[52] U.S. Cl. ..... 430/49; 101/467

[58] Field of Search ..... 430/49; 101/467

[56] References Cited

U.S. PATENT DOCUMENTS 4,880,716 11/1989 Kato et al. ..... 430/49
5,104,760 4/1992 Kato et al. ..... 430/49
5,637,428 6/1997 Horie et al. ..... 430/49

OTHER PUBLICATIONS

P. Matusche et al., *Water–Soluble Photoresins Based on Polymeric Azo Compounds*, "Reactive Polymers", vol. 24, pp. 271–278, (1995).

*Primary Examiner*—John Goodrow
*Attorney, Agent, or Firm*—Oliff & Berridge, PLC

[57] ABSTRACT

The present invention is a method and system for lithographic printing by controlling the surface energy of a printing plate to affect the hydrophilic and hydrophobic properties of the printing plate. These properties enable the ink to be applied to the printing plate in an image-wise manner and provides for rapid production of images on a recording medium. The lithographic printing plate may be rewritten repeatedly between printing jobs or may even be rewritten between individual recording media.

32 Claims, 9 Drawing Sheets

PRINTING PLATE WITH REVERSIBLE CHARGE-CONTROLLED WETTING

BACKGROUND OF THE INVENTION

1. Field of Invention

This invention relates to lithographic printing. In particular, this invention relates to a rewritable lithographic printing plate and systems and methods for rewriting the plate by controlling the reversible hydrophobic/hydrophilic properties of the surface of the plate.

2. Description of Related Art

Conventional lithographic printing plates are prepared with image-wise hydrophobic/hydrophilic areas. Water is then exposed to the hydrophobic/hydrophilic surfaces of the plate. The water avoids all of the hydrophobic areas, but clings to all of the hydrophilic areas. The surface of the plate is then exposed to an oil-based ink. Since the oil-based ink and the water are immiscible, the oil-based ink avoids the areas that are coated with water and adheres to the remaining areas. In other words, the oil only clings to the hydrophobic areas. The oil-based ink and water is then transferred to a blanket cylinder and then onto a recording medium, such as paper.

Conventional lithographic printing plates are generally prepared outside of printing presses. Thus, a plate must first be prepared using a dedicated printing plate preparation machine and then installed in a lithographic printing press. This preparation and installation wastes valuable time and must be performed for each image that is to be printed. This problem is compounded in color lithographic printing systems which require a different plate for each color of an image to be prepared and installed. Additionally, newly prepared plates cannot be installed without first removing and disposing of any plates that are already in the press and which are being replaced. The plates being replaced cannot be rewritten and, therefore, represent a significant waste of materials, energy and time.

The preparation time of conventional lithographic printing plates is also very lengthy. Each plate requires several minutes to prepare. Typically, blank lithographic printing plates have a hydrophobic surface which is conditioned to provide hydrophilic regions which are distributed on the surface in an image-wise manner. One example of a lithographic printing plate preparation process involves a blank lithographic printing plate having a surface that is coated with a hydrophobic photopolymer film. This film is exposed to light from a laser. The photopolymer reacts to the light and the light-exposed areas of the hydrophobic photopolymer film are removed by exposing the surface to a chemical solvent. This process is wasteful because the hydrophobic photopolymer film is not recoverable and the solvent requires special handling and control.

Another example of a conventional lithographic printing plate preparation method involves a blank lithographic printing plate having a surface coated with a hydrophilic silicone rubber film. The blank lithographic printing plate is also exposed to light from a laser in an image-wise manner. However, the laser removes the silicone rubber film and the chemical solvent exposing step is avoided.

Another conventional lithographic printing plate has a surface with an oleophobic silicone rubber film distributed in an image-wise manner. This type of plate may be used in a waterless lithographic printing process which has an advantage that the ink and the water do not have to be carefully balanced. The waterless lithographic printing plate has two different areas. A first area has an oleophobic silicone rubber film to which the ink will not bond and a second area which has had the oleophobic silicone rubber removed and which exposes an underlying substrate to which the ink will bond. The ink is then exposed to the surface of the plate and the ink only covers the areas where the silicone rubber has been removed. Subsequently, the ink is transferred to a blanket cylinder and then onto a recording medium.

SUMMARY OF THE INVENTION

None of these plates have reversible hydrophobic/hydrophilic properties on the surface of the plate. Therefore, the plates cannot be rewritten or reused. Additionally, the conventional lithographic printing plates must be prepared outside of the printing press using a lengthy preparation process and then installed into the printing press.

This invention provides systems and methods that rapidly write and rewrite a lithographic printing plate using a process that does not require a chemical solvent.

This invention separately provides systems and methods for writing, erasing, and rewriting a lithographic printing plate.

This invention separately provides a writable, erasable and rewritable lithographic printing plate.

This invention separately provides a writable, erasable and rewritable lithographic printing plate that is writable and erasable using a photoreceptor having charge-dependent hydrophilic and hydrophobic properties.

This invention separately provides a writable, erasable and rewritable lithographic printing plate using a photoreceptor that is having charge-dependent oleophilic and oleophobic properties.

In an exemplary embodiment of the systems and methods according to this invention an image is written on the plate while it is inside a lithographic printing press and writes the image onto the plate at a speed that approximately equals the printing speed of the press.

The systems and methods, and the lithographic printing plate, of this invention provide many of the economical benefits of conventional lithographic printing methods, such as using low cost inks, allowing a wide range of paper types and allowing other recording substrates.

The systems and methods, and the lithographic printing plate, of this invention can also be combined with digital printing processes to provide customization in short print runs. In this case every page may be customized while being printed at the high operating speed of the printing press.

In another exemplary embodiment of the systems and methods of this invention photoreceptors are used in combination with other layers on a lithographic printing plate to enable image-wise laser beam patterning of hydrophobic and hydrophilic areas on the surface of the lithographic printing plate. The high photosensitivity of photoreceptors enables the writing and rewriting of the lithographic printing plates of this invention at speeds that are orders of magnitude faster than which have previously been conventionally available.

In one exemplary embodiment of the lithographic printing plate of this invention, the local surface energy of the lithographic printing plate is controlled to control the hydrophobic/hydrophilic nature of the surface of the plate in an image-wise manner by creating charged and neutral regions on the surface to enable lithographic printing. In other exemplary embodiments of the lithographic printing plate of this invention, photoreceptors or charged receptor layers are combined with other layers to provide controllable and reversible hydrophobicity or hydrophilicity to the surface of the lithographic printing plate of this invention.

BRIEF DESCRIPTION OF THE DRAWINGS

The preferred embodiments of this invention will be described in detail, with reference to the following figures, wherein.

DETAILED DESCRIPTION OF PREFERRED EMBODIMENTS

The methods and systems of this invention control the surface energy of a lithographic printing plate to affect the hydrophilic and hydrophobic properties of the printing plate. These properties enable the ink to be applied to the printing plate according to this invention in an image-wise manner and provides for rapid production of images on a recording medium. The lithographic printing plate according to this invention may be rewritten repeatedly between printing jobs or may even be rewritten between individual recording media.

These hydrophobic/hydrophilic properties are related to the surface free energy of the lithographic printing plate according to this invention. Surface free energy is the energy that is required to form a unit area of the surface. Surface free energy measures self attraction caused by net inward forces that are exerted by surface molecules. With liquids, surface free energy is equivalent to surface tension. A related mechanism is interfacial free energy, which is the energy required to form an additional new interface between two substances. The interfacial free energy is attributed to the chemical dissimilarities between two materials and is a measure of the repellency between these two materials. The interfacial free energy is also commonly known as wetting ability. If the interfacial free energy is high, the wetting ability is low and the liquid will not adhere to the surface. By contrast, if the interfacial free energy is low, the liquid will adhere to the surface and the wetting ability will be high. The methods and systems of this invention control the interfacial free energy between the surface of a lithographic printing plate and the liquids to control the wetting ability of oil-based inks.

Figure 1:
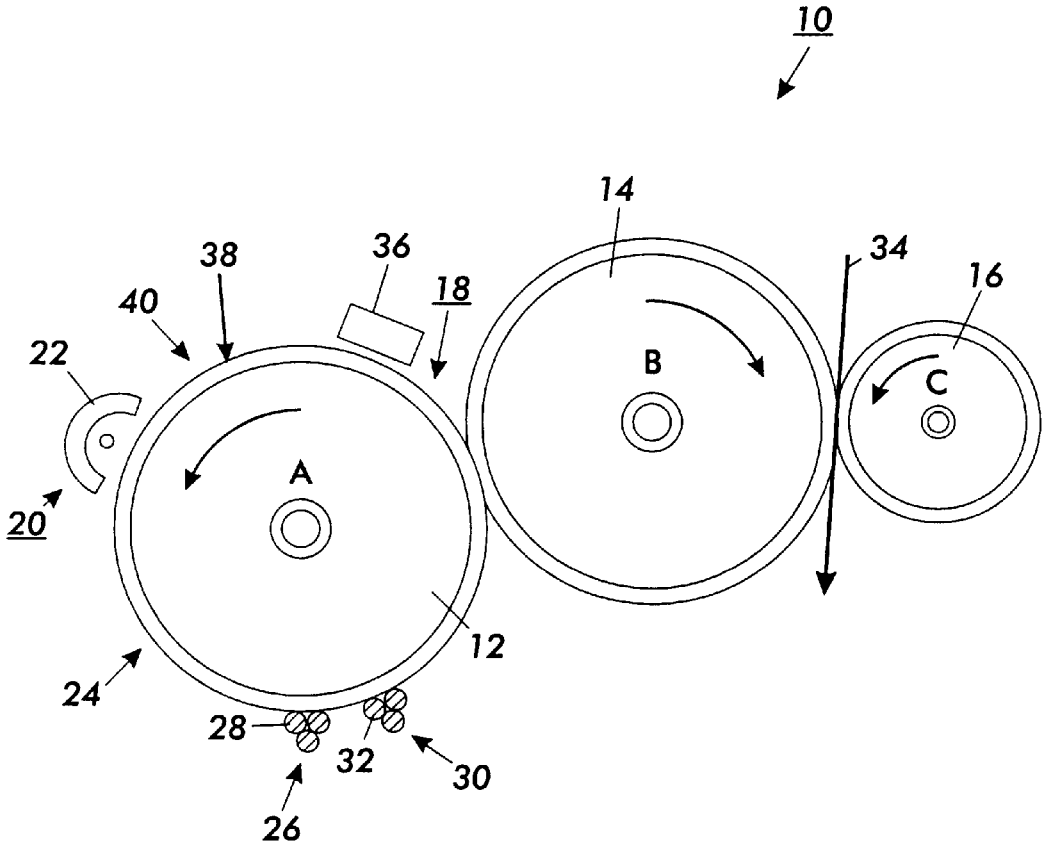
FIG. 1 schematically shows a first exemplary embodiment of a lithographic printing system in accordance with the invention.

FIG. 1 shows a first exemplary embodiment of a lithographic printing system 10 in accordance with this invention. The lithographic printing system 10 includes a printing plate 12, an offset roller 14 and a pressure roller 16. As shown in FIG. 1, each of the printing plate 12, the offset roller 14 and the pressure roller 16 rotate in the direction of the corresponding arrows A, B, and C. The printing plate 12 has a surface 18 that rotates through a number of processing stations that are positioned about the periphery of the printing plate 12. The surface 18 of the lithographic plate 12 rotates through a charging station 20 that uniformly distributes charged ions onto the surface 18 of the printing plate 12. The charging station 20 can include any known or later developed charging devices, such as a corona discharge device 22. Thus, the charging station 20 may include any type of charging device as long as the charging device provides a uniform distribution of charged ions to the surface 18.

The surface 18 rotates from the charging station 20 to an exposure station 24. At the exposure station 24, the surface 18 is exposed to light in an image-wise manner. The exposure station 24 may include any known or later developed type of exposing device, such as a laser raster output scanner (ROS), a page-width light emitting diode printbar, or the like. The light exposure station 24 exposes the photoreceptors on the surface 18 to provide a latent charge image which, in turn, defines the distribution of hydrophobic and hydrophilic areas on the surface 18. The surface 18 then rotates to a water exposing station 26. At the water exposing station 26, the surface 18 is exposed to water 28. In particular, water 28 adheres only to the hydrophilic areas of the surface 18. Therefore, water 28 adheres to the surface 18 in an image-wise manner. The surface 18 then rotates to ink exposing station 30. At the ink exposing station 30, hydrophobic ink 32 contacts the surface 18 of the printing plate 12. The ink 32 then adheres to the hydrophobic areas of the surface 18, but is repelled from and does not adhere to the hydrophilic areas on the surface 18 that are coated with water 28. At this point, the surface 18 is covered with oil and water in an image-wise manner.

The surface 18 then rotates into contact with the offset roller 14. The ink from the printing plate 12 adheres to the offset roller 14 in an image-wise manner. The offset roller 14 then rotates into contact with a recording medium 34 which receives the ink.

After the printing plate 12 contacts the surface 18 with the offset roller 14, the surface 18 rotates to a cleaning station 35. The cleaning station 36 removes any ink and water that remains on the surface 18 of the printing plate 12.

In an embodiment of the present invention, which will be described in more detail in reference to FIG. 8, the surface 18 rotates to a replenishing station 38. The replenishing station 38 replenishes an aqueous medium on the surface 18.

The surface 18 then rotates from the replenishing station to an erasing station 40. The erasing station 40 discharges any remaining charge from the surface 18. Alternatively, as described below the erasing station 40 can selectively discharge portions of the charged areas on the surface 18. Alternatively, the erasing station 40 need not erase any portion of the surface, so that the image-wise charge remains on the photoreceptor to induce another identical lithographic inking and transfer.

The surface 18 then rotates back to the charging station 20 and the process is repeated.

Figure 2:
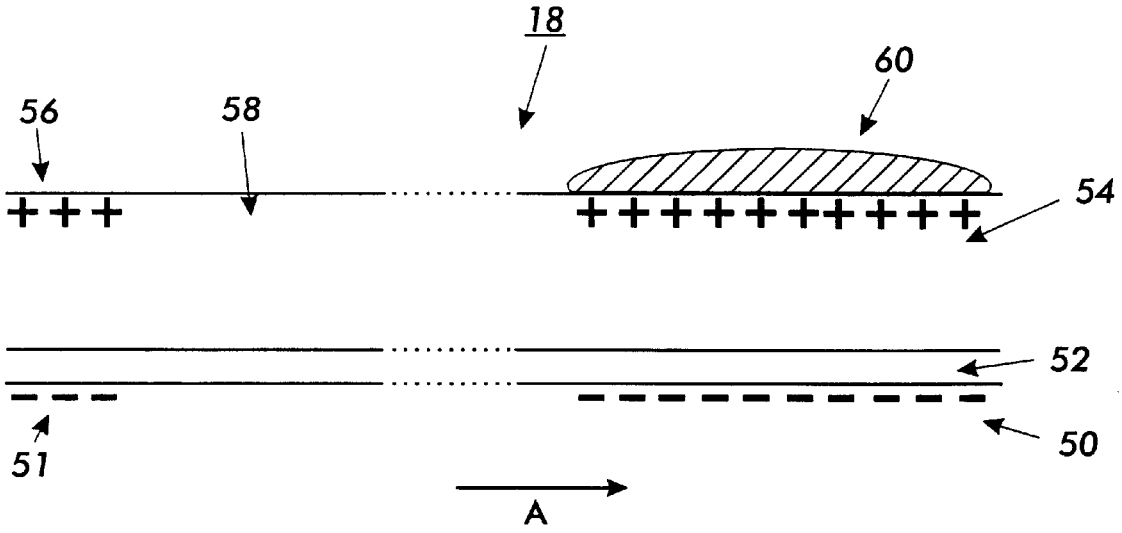
FIG. 2 shows an enlarged cross-section of the exemplary embodiment of a first surface of the lithographic printing plate of the lithographic printing system of FIG. 1.

FIG. 2 shows an enlarged cross-section of the surface 18 of the printing plate 12. The surface 18 includes an electrically grounded substrate 50, a charge generating layer 52 and an electron transport layer 54. The surface 18 moves through the processing stations shown in FIG. 1 in accordance with arrow A. The charging station 20 uniformly distributes charged ions 56 onto the surface 18 as shown. In the embodiment shown in FIG. 2, the charging station 20 has distributed positive charges 56 onto the surface 18. These positive charges 56 attract negative charges 57 in the electrically grounded substrate 50 to rise to the surface of the electrically grounded substrate 50. However, the negative charges 57 are trapped below the charge generating layer 52 because the charge generating layer 52 is nonconductive.

As the surface 18 is exposed by the light exposing device 24, the volume of the charge generating layer that is exposed to the light 58 generates charge pairs that dissipate the positive charges 56 on the surface and the negative charge 57 in the electrically grounded substrate 50 in an image-wise manner. Thus, image-wise charged and discharged regions are formed on the surface 18. The charged and discharged regions on the surface affect the hydrophobic/hydrophilic nature of the surface. The surface 18 then proceeds to the ink exposing station 30 where the surface 18 is exposed to a polar liquid that adheres to the hydrophilic regions of the surface 18 as shown at 60. The polar liquid does not wet the discharged regions. In one exemplary embodiment, the polar liquid is a polar ink. Alternatively, the polar liquid is transparent and is used to repel subsequently applied oil-based ink.

Figure 3:
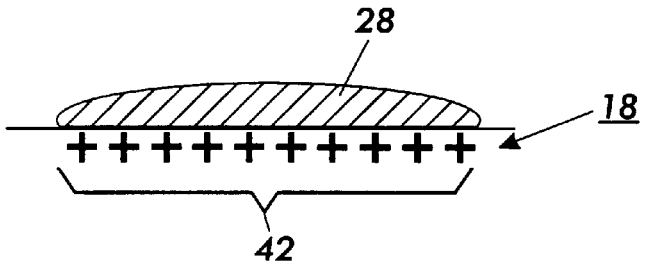
FIG. 3 shows an enlarged cross-section of a second exemplary embodiment of a surface of a lithographic printing plate in accordance with the invention with a drop of water on the surface.
Figure 4:
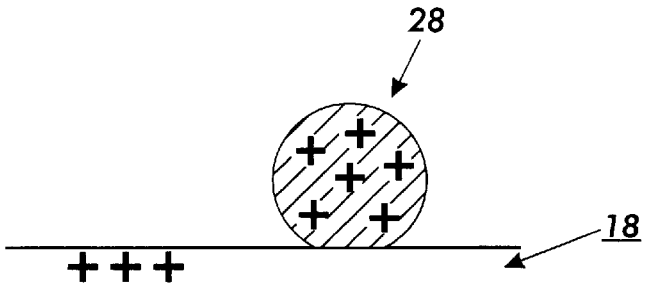
FIG. 4 shows the second exemplary embodiment of the surface of the lithographic printing plate and the drop of water of FIG. 3 after the drop has received a portion of the surface charge.

FIG. 3 shows the initial state of a polar liquid, such as water 28, immediately after it is brought into contact with the charged regions 42 of the surface 18. As shown in FIG. 3, ions of charge opposite to those of the photoreceptor are attached to the interface, thereby reducing the interfacial energy sufficiently to enable liquid binding. The distribution of water 28 accurately matches the distribution of the charged areas 42 of the surface 18 of the printing plate 12. Additionally, FIG. 3 shows that water 28 adheres well to the surface 18 in the charged region 42. However, FIG. 4 shows a potential problem that occurs as charges 56 are taken up by water 28. As the charges 56 are taken up by water 28, the interfacial energy at the surface 18 is raised and water 28 no longer adheres well to the surface 18 of the printing plate 12. Thus, water 28 may migrate along the surface 18. Thermodynamic analysis shows that it may be energetically favorable for the charges 56 to enter and disperse into the interior of the drop of water 28. When the charges 56 depart from the surface 18, the surface 18 again becomes hydrophobic. However, the kinetics of any charge take-up by water 28 and the resultant dewetting of the surface 18 may be slow enough to allowing printing to take place.

Figure 5:
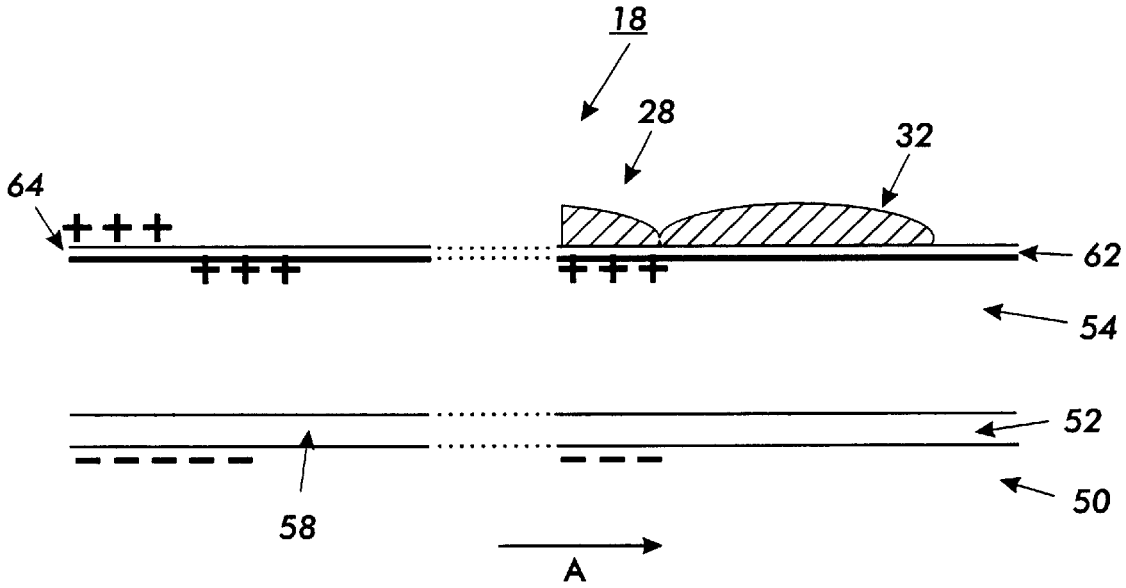
FIG. 5 shows an enlarged cross-section of a third exemplary embodiment of a surface of a lithographic printing plate in accordance with the invention.

FIG. 5 shows a second exemplary embodiment of the structure of the surface 18. The structure of the surface 18 shown in FIG. 5 addresses the potential problem of charge take-up by water 28. As shown in FIG. 5, the surface 18 includes the electrically grounding substrate 50, the charge generating layer 52 and the electron transport layer 54 described above with respect to FIG. 2. However, the surface 18 in FIG. 5 also has a layer 62 containing double heterostructure sublayers or charge trap sites, as well as an upper hole transport layer 64. The surface 18 shown in FIG. 5 proceeds through the same processing stations described above in reference to FIGS. 1 and 2. However, as shown in FIG. 5, the charges 56 that are applied by the charging station 20 are pulled through the upper transport layer 64 and collected in the charge trap sites 62. The charge trap site layer 62 is also known as a binding layer. The binding layer prevents charge take-up by water 28 and also serves to prevent lateral conductivity of the charges 56 across the surface 18 to prevent blurring of the image.

Figure 6:
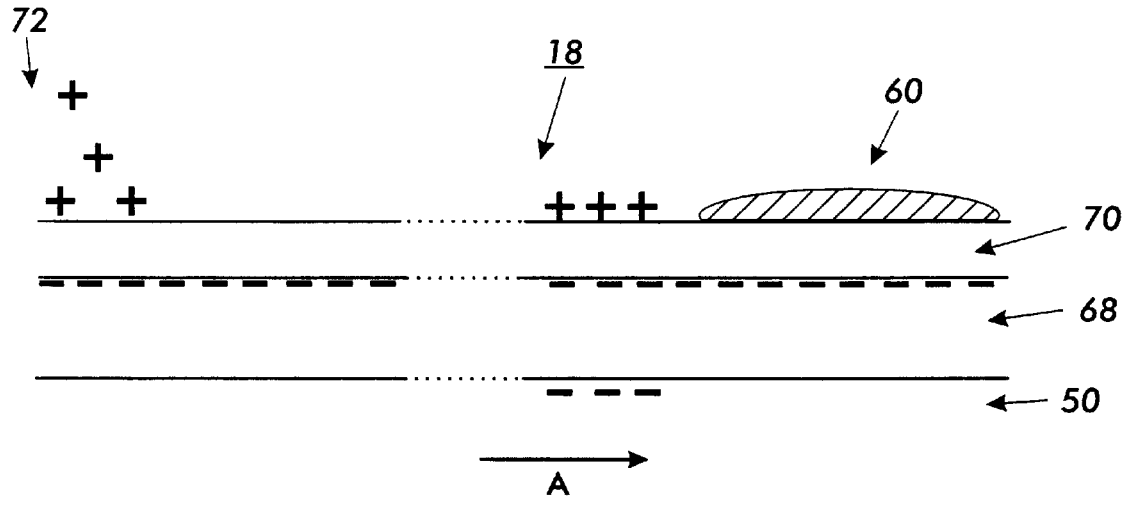
FIG. 6 shows an enlarged cross-section of a fourth exemplary embodiment of a surface of a lithographic printing plate in accordance with the invention.
Figure 7:
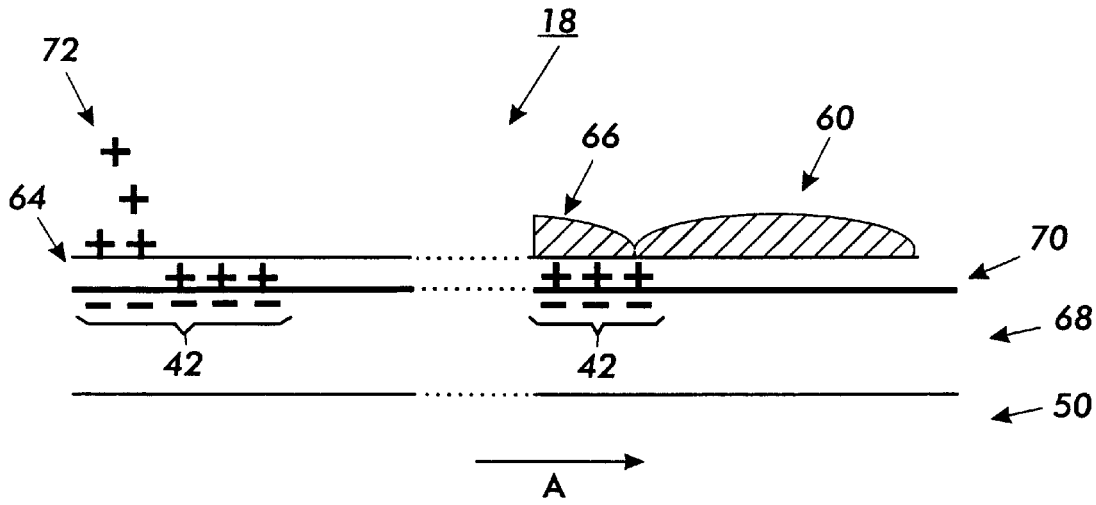
FIG. 7 shows an enlarged cross-section of a fifth exemplary embodiment of a surface of a lithographic printing plate in accordance with the invention.

FIGS. 6 and 7 each show exemplary embodiments of a lithographic printing plate 12 in accordance with the invention that do not rely upon photo-induced charged pattern generation. As shown in FIG. 6, the surface 18 includes an electrically grounded substrate 50, a conductive drum 68 and an insulating layer 70. The surface 18 is exposed to a stream of charged ions or electrons 72 that is emitted using a field emitter array, a Corjet or the like. The charged ion stream 72 is applied in an image-wise manner. Alternatively, charge of one sign is uniformly applied and then charge of the opposite sign is applied in an image-wise manner. The water adheres to the charged areas and the oil-based ink 60 adheres to the noncharged areas.

As shown in FIG. 7, the surface 18 also has the electrically grounded substrate 50, the conductive drum 68 and the insulating layer 70, as shown in FIG. 6, but further includes the upper hole transport layer 64. Charges are retained next to the insulating layer 70. The polar liquid 66 (for example, water) is then attracted to the charged regions 42 and the oil-based ink is repelled by the water-coated regions and adheres to the discharged regions in an image-wise manner.

The image is erased by grounding through a conducting contact, such as a carbon fiber brush, or by a flood or image-wise application of counter charges. By way of non-limiting example, materials which may be useful as a substrate film for the surface 18 include: polyether carbonate, polyethylene terephthalate, polystyrene and polycarbonates.

Figure 8:
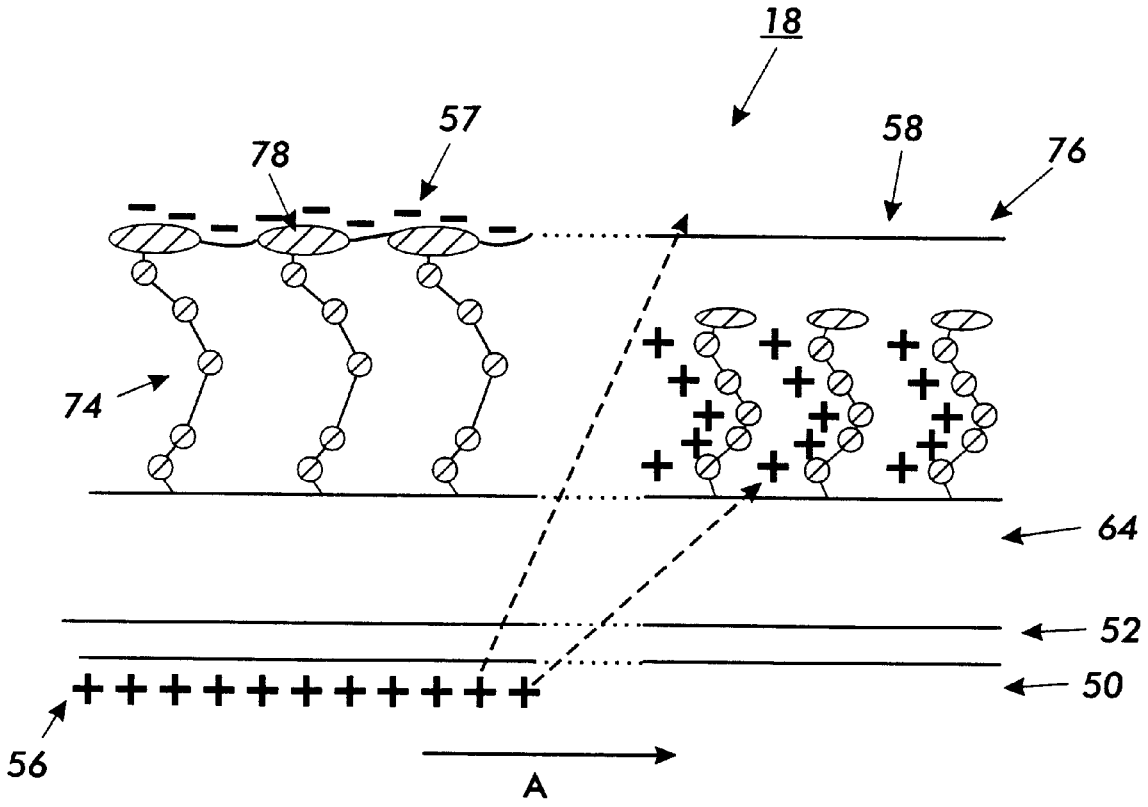
FIG. 8 shows an enlarged cross-section of a sixth exemplary embodiment of a surface of a lithographic printing plate that has polyelectrolyte brushes in accordance with the invention.

FIG. 8 shows a sixth exemplary embodiment of the surface 18, where the hydrophobic and hydrophilic characteristics of the surface of a printing plate is altered using a polyelectrolyte brush 74. The polyelectrolyte brush 74 is grafted onto the hole transport layer 64. During printing, the polyelectrolyte brush 74 is swollen with an aqueous solution 76. Each strand of the polyelectrolyte brush 74 has a hydrophobic head 78 which is buoyed to the surface of the aqueous solution 76. The spine of each strand of the polyelectrolyte brush 74 includes negative ions which tend to repel each other. This repellent force keeps the spines relatively stiff, and also serves to support the hydrophobic heads 78.

After the polyelectrolyte brush 74 is swollen with the aqueous solution 76, the hydrophobic heads 78 are uniformly coated with negative charges 57 at the charging station 20. The negative charges 57 on the hydrophobic head attract positive charges 56 to the surface of the electrically grounded substrate 50. Subsequently, the surface 18 is rotated through the exposure station 24. The charge generating layer 52 generates charged pairs which dissipate the positive charges 56 from the surface of the electrically grounded substrate 50, dissipates the negative charges 57 on the surface of the hydrophobic heads 78, and also counteracts the repelling force of the negative ions in each strand of the polyelectrolyte brush 74 by pairing positive charges with these negative ions. As a result, in light exposed areas, the spine of each strand of the polyelectrolyte brush 74 tends to collapse and pulls the hydrophobic heads 78 below the surface of the aqueous medium 76. Therefore, the image-wise exposure of the polyelectrolyte brush 74 provides an image-wise submersion of the hydrophobic heads 78 of the polyelectrolyte brush 74. Therefore, the surface 18 is provided with hydrophobic and hydrophilic areas in an image-wise manner and oil-based lithographic printing may be performed.

To recover the original hydrophobic surface, negative ions are applied to the brush-air interface, which causes positive charges to be pulled off of the negative backbone of each strand of the polyelectrolyte brush 74 and which restores the original chain stiffness and allows the hydrophobic head 78 to rise to the brush-air interface.

In another exemplary embodiment of the surface 18, if the aqueous medium 76 contains photoionizable small molecules, the counterions required to allow brush relaxation can be generated by light directly within the swollen brush.

Preferably, the polyelectrolyte brush 74 is no thicker than a few tens of nanometers. A layer this thin with grafted polymer molecules is very resistant to being squeezed or wiped off the drum. A grafted polymer 74 brush such as this has been used to protect disk drive heads. The photoreceptor insulating film must be a pinhole free hydrophilic surface.

After lithographic printing has been performed using the surface 18 shown in FIG. 8, the hydrophobic nature of the surface 18 may be restored by supplying negative charges 57 to the surface of the aqueous medium 76. The negative charges 57 pull the positive charges 56 off of the negative backbone of each strand of the polyelectrolyte brush 74, which restores the stiffness to each of the strands of the polyelectrolyte brush 74 and permits the hydrophobic head 78 to rise to the surface of the aqueous medium 76. Accordingly, this "erases" the image-wise distribution of hydrophobic and hydrophilic regions.

In another embodiment of the surface 18, the aqueous medium 76 may be provided with photoionizable molecules which provide positive charges 56 to provide brush relaxation.

In another exemplary embodiment of the surface 18, the hydrophilic nature of a surface is controlled by AZO compounds. These AZO compounds are in a water solution and are exposed to a tuned laser to remove ions to change their hydrophilic properties to hydrophobic. The hydrophobic AZO compound then rises to the surface of the water solution and combines with and supports an oil-based ink. Thereafter, the ink, in combination with the modified AZO compound, can be transferred with the water solution to a lithographic blanket, and is subsequently transferred to a recording medium. The AZO compounds that are removed in this manner may be replenished by providing additional water solution with unmodified AZO compounds. A description of AZO compounds which may be useful for this embodiment of the surface 18 is found in *Water-Soluble Photoresins Based On Polymeric AZO Compounds,* P. Matusche, et al., Reactive Polymers 24 (1995), pp. 271–278.

Figure 9:
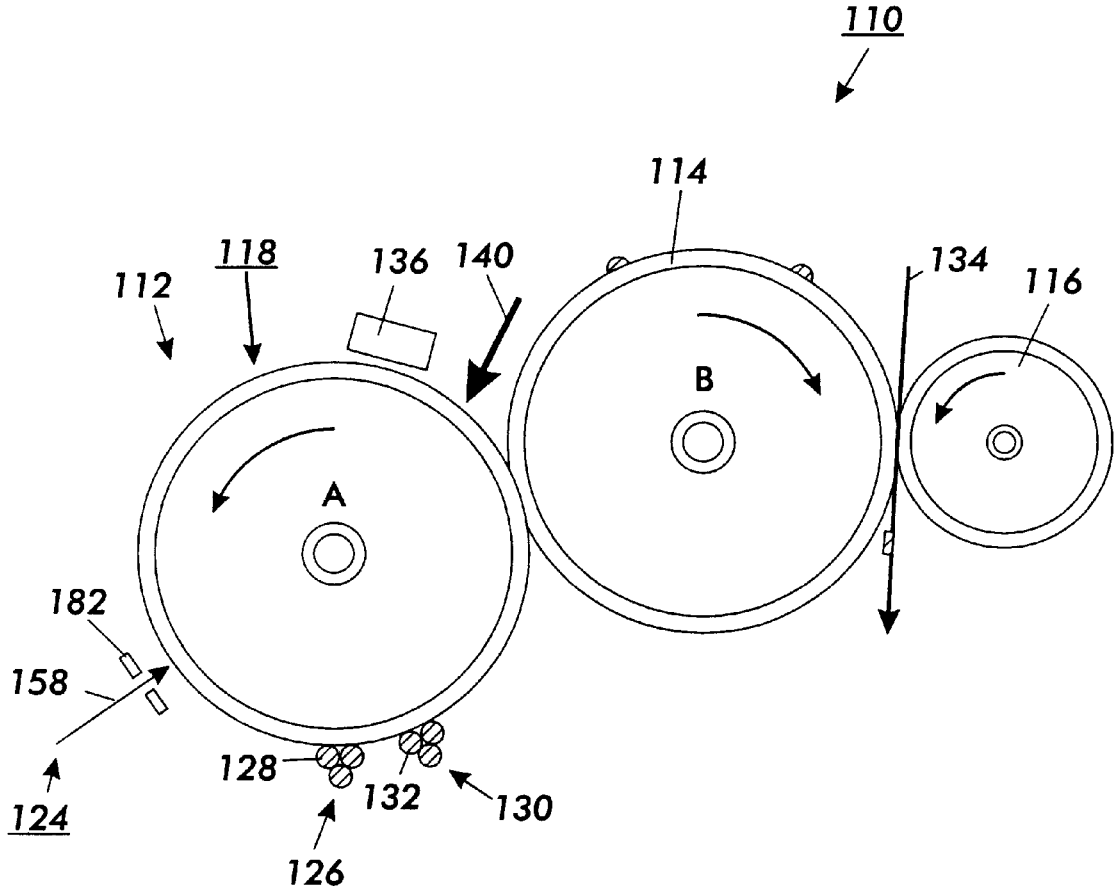
FIG. 9 schematically shows a second exemplary embodiment of a lithographic printing system in accordance with the invention.

FIG. 9 shows a second exemplary embodiment of a lithographic printing system 100 in accordance with the invention. As shown in FIG. 9, the lithographic printing system 100 does not require the charging station 20 or the replenishing station 38 of the lithographic printing system 10. Rather, the lithographic printing system 100 of FIG. 13 has an exposure station 124 that exposes the surface 118 of the lithographic printing plate 112 to light 158 in a high intensity electric field 182. The exposure station 124 is shown in more detail in FIG. 10.

Figure 10:
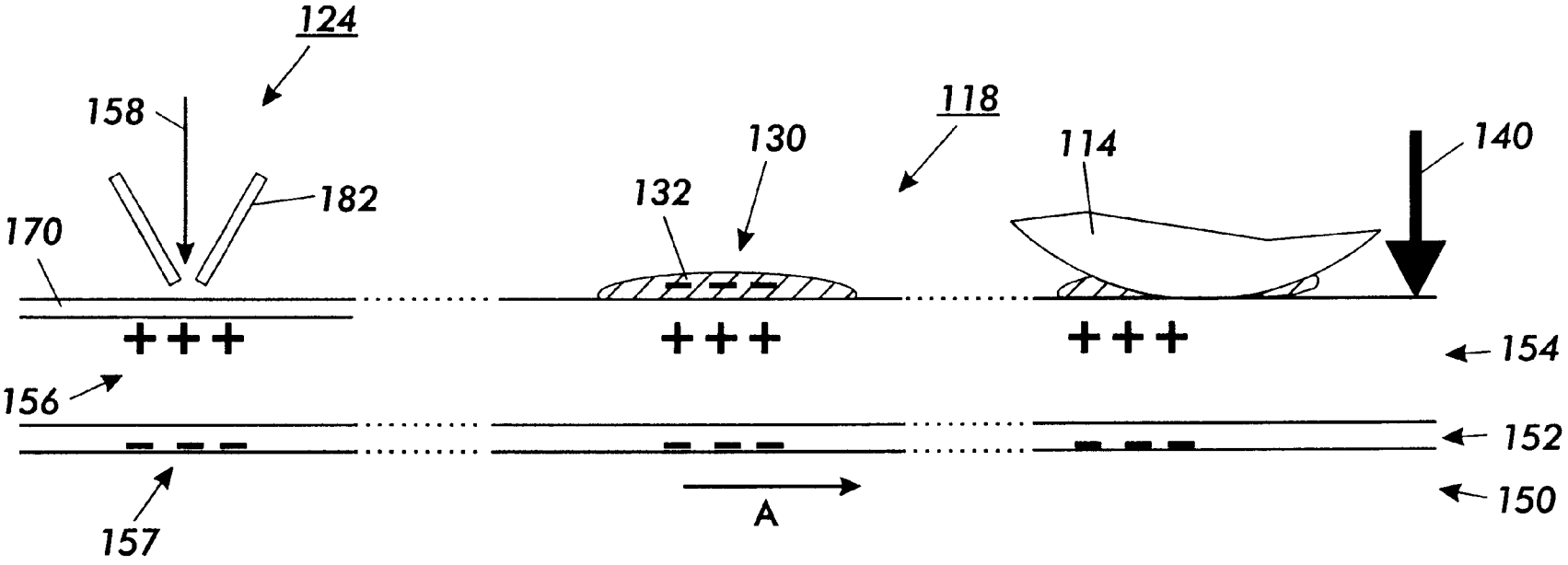
FIG. 10 shows an enlarged cross-section of one exemplary embodiment of a surface of a lithographic printing plate of the system of FIG. 9.

FIG. 10 shows a cross section of the surface 118 of the printing plate 112 as it proceeds through the processing stations of the lithographic printing system 100. The surface 118 of the lithographic plate 112 includes an electrically grounded substrate 150, a charge generating layer 152, an electron transport layer 154 and an insulating layer 170. As the surface 118 passes through the exposure station 124, the exposure station 124 generates light 158 in an image-wise manner. The light 158 passes through the insulating layer 170 and the electron transport layer 154, and causes the charge generating layer 152 to generate charge pairs. The high intensity field 182 causes the charge pairs to be separated and to cause the positive charges 156 to migrate through the electron transport layer 154 while the negative charges remain at the interface between the charge generating layer 152 and the electrically grounded substrate 150.

After the surface 118 leaves the exposure station 124, the surface 118 has hydrophobic and hydrophilic areas that are arranged in an image-wise manner. When the surface 118 proceeds through the water exposing station 126, the water 128 is attracted to the hydrophilic areas in the image-wise manner. The surface 118 proceeds to the inking station 130, where oil-based ink 132 is repelled by the water covered areas and adheres to the hydrophobic areas. Then, as the surface 118 proceeds into contact with the offset roller 114, the ink is transferred from the surface 118 to the offset roller 114.

Subsequently, the surface 118 proceeds through an erasing station 140, which may either selectively erase or flood erase the surface 118 with light to dissipate the charged pairs and to prepare the surface 118 for further operations. The erasing station 140 may include a scanning laser which only changes the portions of the image where data has been changed to enable rewriting of the same image or modifying and writing of a new image. Alternatively, the erasing station 140 need not erase any portion of the surface, so that the image-wise charge remains on the photoreceptor to induce another identical lithographic inking and transfer. Similarly, the high intensity field 182 may be modulated in an image-wise manner to enable the data to be erased or written only as needed.

Figure 11:
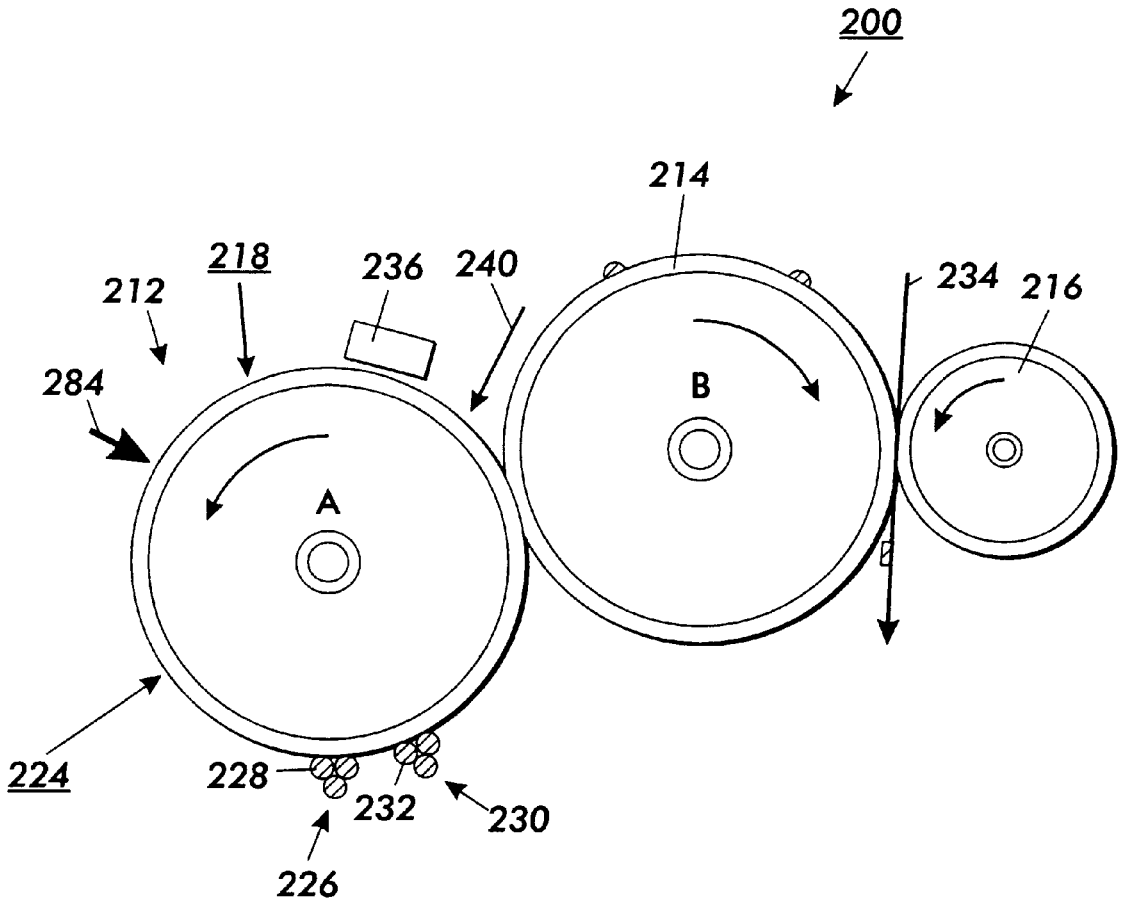
FIG. 11 schematically shows a third exemplary embodiment of a lithographic printing system in accordance with the invention.

FIG. 11 shows a third exemplary embodiment of a lithographic printing system 200 in accordance with the invention. The lithographic printing system 200 of FIG. 11 is similar to the lithographic printing system 100 described in FIG. 1. However, the lithographic printing system 200 of FIG. 11 includes a blanket precharging station 284 which is followed by an exposure station 224 that provides for image-wise discharging.

Figure 12:
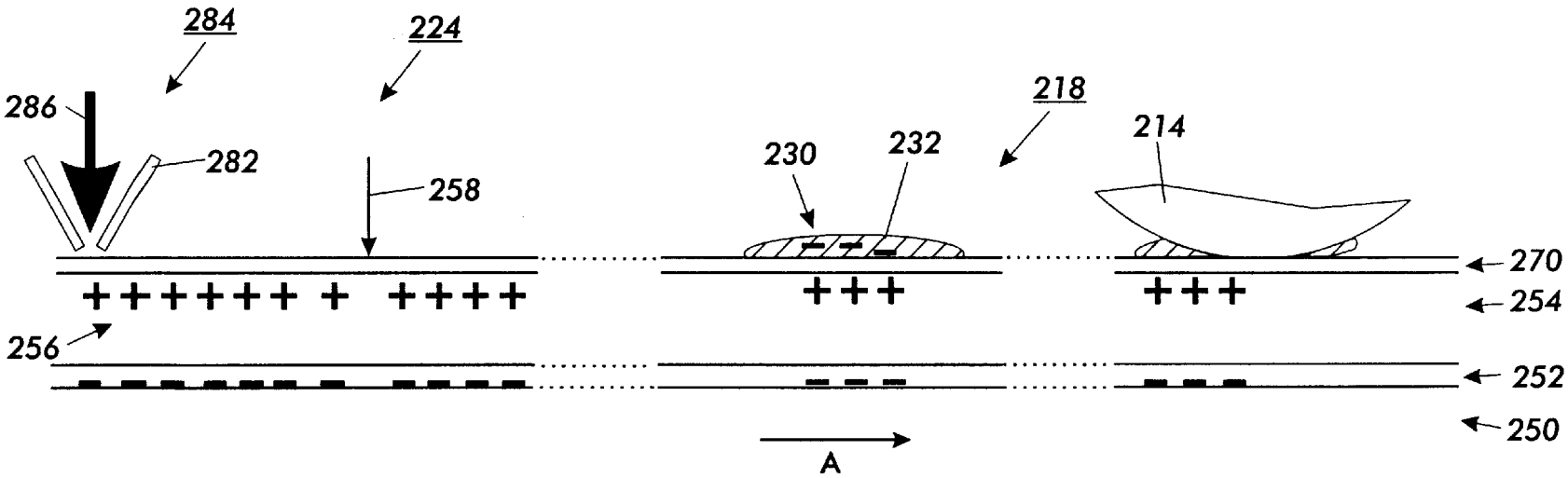
FIG. 12 shows an enlarged cross-section of one exemplary embodiment of a surface of a lithographic printing plate of the system of FIG. 11.

FIG. 12 shows a cross-section of the surface 218 of the printing plate 212 of FIG. 11 as it passes through the processing stations of the lithographic printing system 200. The surface 218 includes an electrically grounded substrate 250, a charge generating layer 252, an electron transport layer 254, and an insulating layer 270. The surface 218 first encounters the blanket precharging station 284, which includes a flood illumination light 286 and a high intensity field 282. The flood illumination light 282 generates charge pairs in the charge generating layer 252. The high intensity field 286 separates the charge pairs and brings the positive charge 256 from each of the charge pairs to the surface below the insulating layer 270. The surface 218 then proceeds to the exposure station 224 where light 258 exposes the surface 218 in an image-wise manner and dissipates the charged pairs where the light encounters the surface 218. The surface 218 at this point includes charged and uncharged areas which affect the hydrophobic and hydrophilic nature of the surface in an image-wise manner.

After the surface 218 leaves the exposure station 224, the surface 218 has hydrophobic and hydrophilic areas that are arranged in an image-wise manner. When the surface 218 proceeds through the water exposing station 226, the water 228 is attracted to the hydrophilic areas in the image-wise manner. The surface 218 proceeds to the inking station 230, where oil-based ink 232 is repelled by the water covered areas and adheres to the hydrophobic areas. Then, as the surface 218 proceeds into contact with the offset roller 214, the ink is transferred from the surface 218 to the offset roller 214.

As shown in FIG. 11, the surface 218 may then rotate through an erasing station 240 which may include a flood illumination source or the like, and then through a cleaning station 236, which may include a doctor blade or the like. The cycle may then be repeated.

It is to be understood that while the embodiments described above are all lithographic printing systems that the lithographic printing plate may be used with any type of lithographic printing press and/or technique regardless of whether it is a lithographic printing press and/or technique.

While this invention has been described with the specific embodiments outlined above, many alternatives, modifications and variation are apparent to those skilled in the art. Accordingly, the preferred embodiments described above are illustrative and not limiting. Various changes may be made without departing from the spirit and scope of the invention.

What is claimed is:

1. A lithographic printing plate with reversible charge-controlled wetting properties, comprising:

an electrically grounded substrate;

a charge generating layer on the electrically grounded substrate; and a charge transport layer on the charge generating layer, wherein the surface of the lithographic printing plate includes reversible hydrophilic and hydrophobic areas which are provided by image-wise distribution of charges on the printing plate.

2. The lithographic printing plate of claim 1, further comprising an insulating layer on the charge transport layer.

3. The lithographic printing plate of claim 1, further comprising:

a charge trap site layer on the charge transport layer; and an upper charge transport layer on the charge trap site layer.

4. The lithographic printing plate of claim 1, further comprising a polyelectrolyte brush grafted onto the charge transport layer.

5. A lithographic printing plate with reversible charge-controlled wetting properties, comprising:

an electrically grounded substrate;

a conductive drum layer on the electrically grounded substrate; and an insulating layer on the metal drum layer, wherein the surface of the lithographic printing plate includes reversible hydrophilic and hydrophobic areas which are provided by image-wise distribution of charges on the printing plate.

6. The lithographic printing plate of claim 5, further comprising:

a charge trap site layer on the insulating layer; and an upper charge transport layer.

7. A lithographic printing method, comprising:

image-wise distributing charges on a printing plate having reversible charge-controlled wetting properties so as to provide reversible hydrophilic and hydrophobic areas on the surface of the printing plate; and exposing the printing plate to a polar ink.

8. The lithographic printing method of claim 7, further comprising:

contacting the printing plate with another surface; and repeating the charge distributing and ink exposing steps.

9. The lithographic printing method of claim 7, wherein the charge distributing step is customized.

10. A lithographic printing method, comprising:

distributing charges on a printing plate having reversible charge-controlled wetting properties so as to provide reversible hydrophilic and hydrophobic areas on the surface of the printing plate;

exposing the printing plate to light; and exposing the printing plate to a polar ink.

11. The lithographic printing method of claim 10, wherein the charges are uniformly distributed on the printing plate.

12. The lithographic printing method of claim 10, wherein the charges are distributed in an image-wise manner.

13. The lithographic printing method of claim 10, further comprising:

contacting the printing plate with another surface; and repeating the charge distributing, light exposing and ink exposing steps.

14. The lithographic printing method of claim 13, wherein at least one of the charge distributing and light exposing steps is in an image-wise manner.

15. The lithographic printing method of claim 14, wherein the image-wise of the at least one of the charge distributing steps and the light exposing steps is customized.

16. A lithographic printing method, comprising:

distributing charges on a printing plate having reversible charge-controlled wetting properties so as to provide reversible hydrophilic and hydrophobic areas on the surface of the printing plate;

exposing the printing plate to light;

exposing the printing plate to polar liquid; and exposing the printing plate to an oil-based ink.

17. The method of claim 16, wherein the polar liquid is water.

18. The lithographic printing method of claim 16, wherein the charges are uniformly distributed on the printing plate.

19. The lithographic printing method of claim 16, wherein the charges are distributed in an image-wise manner.

20. The lithographic printing method of claim 16, further comprising:

contacting the printing plate with another surface; and repeating the charge distributing, light exposing and ink exposing steps.

21. The lithographic printing method of claim 20, wherein the charge distributing and light exposing steps are in an image-wise manner.

22. The lithographic printing method of claim 21, wherein at least one of the charge distributing steps and the light exposing steps is customized.

23. A lithographic printing method, comprising:

exposing a printing plate having reversible charge controlled wetting properties to light in a high intensity field so as to provide reversible hydrophilic and hydrophobic areas on the surface of the printing plate;

exposing the printing plate to a polar liquid; and exposing the printing plate to an oil-based ink.

24. The lithographic printing method of claim 23, wherein the printing plate is exposed to light in an image-wise manner.

25. The lithographic printing method of claim 23, wherein the high intensity field is applied in an image-wise manner.

26. The lithographic printing method of claim 23, further comprising:

contacting the printing plate with another surface; and repeating the light exposing and ink exposing steps.

27. The lithographic printing method of claim 23, wherein the light exposing step is customized.

28. A lithographic printing method, comprising:

exposing a printing plate having reversible charge controlled wetting properties to light in a high intensity field so as to provide reversible hydrophilic and hydrophobic areas on the surface of the printing plate; and exposing the printing plate to a polar ink.

29. The lithographic printing method of claim 28, wherein the printing plate is exposed to light in an image-wise manner.

30. The lithographic printing method of claim 28, wherein the high intensity field is applied in an image-wise manner.

31. The lithographic printing method of claim 28, further comprising:

contacting the printing plate with another surface; and repeating the light exposing and ink exposing steps.

32. The lithographic printing method of claim 28, wherein the light exposing step is customized.

* * * * *